US010094554B2

(12) United States Patent
Yano et al.

(10) Patent No.: US 10,094,554 B2
(45) Date of Patent: Oct. 9, 2018

(54) DRAIN RECOVERY DEVICE

(71) Applicant: TLV CO., LTD., Hyogo (JP)

(72) Inventors: Takuji Yano, Osaka (JP); Yasuhira Hida, Kakogawa (JP)

(73) Assignee: TLV CO., LTD., Hyogo (JP)

( * ) Notice: Subject to any disclaimer, the term of this patent is extended or adjusted under 35 U.S.C. 154(b) by 0 days.

(21) Appl. No.: 15/341,419

(22) Filed: Nov. 2, 2016

(65) Prior Publication Data

US 2017/0074505 A1 Mar. 16, 2017

Related U.S. Application Data

(63) Continuation of application No. PCT/JP2015/061785, filed on Apr. 17, 2015.

(30) Foreign Application Priority Data

May 9, 2014 (JP) ..... 2014-097496

(51) Int. Cl.
*F22D 11/06* (2006.01)
*F22D 5/30* (2006.01)
*F22D 11/00* (2006.01)

(52) U.S. Cl.
CPC ..... *F22D 5/30* (2013.01); *F22D 11/00* (2013.01); *F22D 11/06* (2013.01)

(58) Field of Classification Search
CPC ... F22D 11/06; F22D 5/00; F22D 5/30; F28B 9/08; F01K 17/00; F22B 35/00; F22B 37/26; F22B 33/10
See application file for complete search history.

(56) References Cited

U.S. PATENT DOCUMENTS 4,385,908 A * 5/1983 Carmichael ..... B01D 19/0047 122/488
5,611,673 A * 3/1997 Agata ..... F04F 5/462 239/433

(Continued)

FOREIGN PATENT DOCUMENTS

JP S61-003904 A 1/1986
JP H04-124503 A 4/1992

(Continued)

OTHER PUBLICATIONS

International Search Report issued in PCT/JP2015/061785; dated Jun. 30, 2015.

*Primary Examiner* — Gregory A Wilson
(74) *Attorney, Agent, or Firm* — Studebaker & Brackett PC

(57) ABSTRACT

In a drain recovery section including a recovery tank to which drain generated in a steam-using device is collected and from which the drain is supplied to a boiler, pressure decrease in the boiler under a high load can be suppressed. A drain recovery section includes: a recovery tank in which drain generated by condensation of steam in a steam-using device is stored and from which water stored in the recovery tank is supplied to a boiler; and a control unit that controls an amount of water supply from the recovery tank to the boiler to prevent the water level of water in the recovery tank from decreasing below a predetermined tank reference water level. When the load of the boiler increases to a predetermined load, the control unit reduces the tank reference water level by a predetermined amount.

3 Claims, 2 Drawing Sheets

(56) References Cited

U.S. PATENT DOCUMENTS

| | | | | |
|---|---|---|---|---|
| 9,500,360 | B2 * | 11/2016 | Akinaga | F22D 1/28 |
| 9,739,477 | B2 * | 8/2017 | Akinaga | F22D 11/06 |
| 2011/0214623 | A1 * | 9/2011 | Choi | F01K 13/02 122/451 R |
| 2015/0076241 | A1 * | 3/2015 | Zhadanovsky | F01K 17/02 237/9 R |

FOREIGN PATENT DOCUMENTS

| | | | |
|---|---|---|---|
| JP | 2006-105442 | A | 4/2006 |
| JP | 2010-164234 | A | 7/2010 |
| JP | 2012-002384 | A | 1/2012 |
| JP | 2012-067970 | A | 4/2012 |
| JP | 2013-205006 | A | 10/2013 |
| JP | 2014-055740 | A | 3/2014 |

* cited by examiner

DRAIN RECOVERY DEVICE

CROSS-REFERENCE TO RELATED APPLICATION

This is a continuation of PCT International Application PCT/JP2015/061785 filed on Apr. 17, 2015, which claims priority to Japanese Patent Application No. 2014-097496 filed on May 9, 2014. The disclosures of these applications including the specifications, the drawings, and the claims are hereby incorporated by reference in their entirety.

TECHNICAL FIELD

The present application relates to a drain recovery device that collects drain generated in a steam-using device and supplies the collected drain to a boiler.

BACKGROUND ART

Japanese Patent Publication No. 2010-164234, for example, describes a known drain recovery device (condensate recovery device) that collects drain (condensate) generated by condensation of steam in a steam-using device and returns the collected drain to a boiler. Such a drain recovery device includes a recovery tank (drain tank) and a make-up water tank (mixing tank). The recovery tank collects drain generated in the steam-using device and stores the collected drain. The make-up water tank stores water generated by condensation of influent steam (flash steam) re-evaporated in the recovery tank or water supplied from another source. Water stored in the recovery tank and water stored in the make-up water tank are supplied to the boiler, and steam is generated by heating.

In such a drain recovery device, water in the recovery tank is mainly supplied to the boiler. Water in the make-up water tank is supplementarily supplied to the boiler when the water supply to the boiler runs short. Specifically, the drain recovery device controls the amount of drain supply from the recovery tank to the boiler so that the water level of the recovery tank does not decrease below a predetermined reference water level. When the water level decreases below the reference water level, for example, water is supplementarily supplied from the make-up water tank to the boiler.

SUMMARY

In the drain recovery device as described above, when a load of the boiler increases and water is supplementarily supplied to the boiler from the make-up water tank, the pressure of the boiler decreases disadvantageously. Specifically, since the recovery tank stores high-temperature water whereas the make-up water tank stores low-temperature water, when water is supplied from both of the tanks to the boiler, the temperature of water supplied to the boiler is lower than that in a case where water is supplied to the boiler only from the recovery tank.

In this situation, the difference between the temperature of the supplied water and a saturated steam temperature is large so that heat is taken from the generated steam and the resulting steam becomes drain. Consequently, the pressure of the boiler decreases. The pressure decrease in the boiler causes unstable pressure and temperature of steam supplied to the steam-using device. As a result, a production process using a steam-using device becomes unstable, causing variations in production quality.

It is therefore an object of a technique disclosed in the present application to suppress a pressure decrease in a boiler under a high load in a drain recovery device including a recovery tank in which drain generated in a steam-using device is collected and from which the drain is supplied to the boiler.

According to a technique disclosed in the present application, to achieve the object, a target water level of a recovery tank is changed to a lower level when a boiler is under a high load.

Specifically, a technique disclosed in the present application is directed to a drain recovery device including: a recovery tank in which drain generated by condensation of steam in a steam-using device is stored and from which water stored in the recovery tank is supplied to a boiler; and a control unit that controls an amount of water supply from the recovery tank to the boiler to maintain a water level of water stored in the recovery tank at a predetermined tank reference water level. When a load of the boiler increases to a predetermined load, the control unit reduces the tank reference water level by a predetermined amount.

As described above, in the drain recovery device according to the present application, when the load of the boiler increases to a predetermined load, the tank reference water level (target water level) of the recovery tank is reduced by a predetermined amount. Accordingly, the amount of water supply from the recovery tank to the boiler can be increased by an amount corresponding to the predetermined amount of the tank reference water level.

In this manner, low-temperature water does not need to be supplementarily supplied to the boiler or the amount of water supplementarily supplied to the boiler can be reduced while the boiler is under a high load. Thus, it is possible to suppress a decrease in pressure of the boiler under a high load. As a result, the pressure of steam generated in the boiler can be stabilized.

DESCRIPTION OF EMBODIMENTS

An embodiment of the present application will be described with reference to the drawings. The following embodiment is a preferred example in nature, and is not intended to limit techniques disclosed here, applications of the techniques, and use of the techniques.

Figure 1:
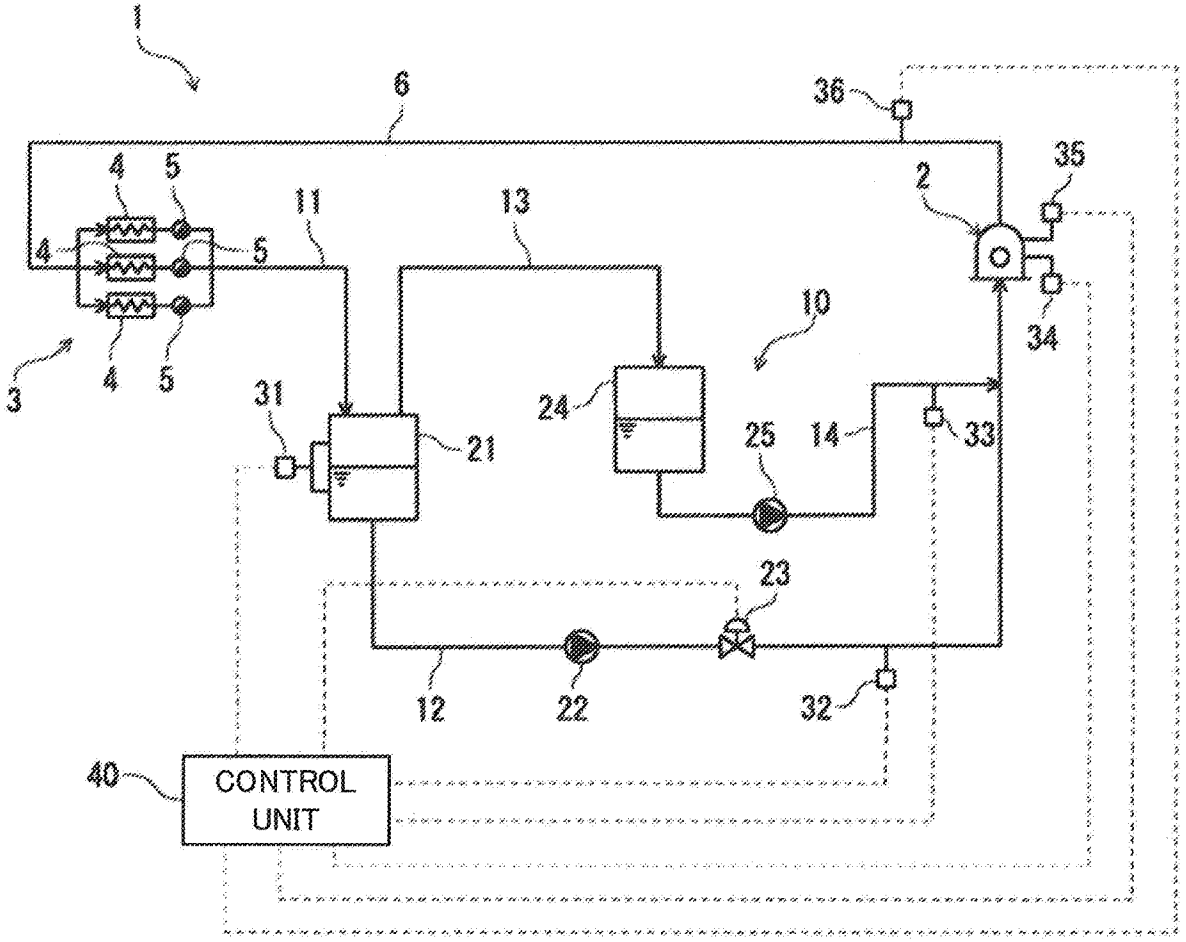
FIG. 1 is a piping diagram schematically illustrating a configuration of a steam system according to an embodiment.

As illustrated in FIG. 1, a steam system 1 according to this embodiment includes a boiler 2, a steam-using section 3, and a drain recovery section 10. The drain recovery section 10 constitutes a drain recovery device recited in claims of the present application.

The boiler 2 includes an unillustrated drum (container), and the drum stores water supplied from the drain recovery section 10, which will be specifically described later. In the drum, water stored in the drum is heated to generate steam. The steam-using section 3 includes a plurality of (three in this embodiment) steam-using devices 4 connected in parallel, and a steam trap 5 is connected to a downstream side of each of the steam-using devices 4. The steam-using section 3 is connected to the boiler 2 through a supply pipe 6, and is supplied with steam generated in the boiler 2. In other words, a downstream end of the supply pipe 6 is branched into three parts respectively connected to the three steam-using devices 4 so that the steam-using devices 4 are supplied with steam. The steam-using section 3 may include one steam-using device 4 and one steam trap 5.

Each of the steam-using devices 4 is, for example, a heat exchanger in which steam supplied from the boiler 2 dissipates heat to a target to be condensed so that the target is heated. When condensed, steam becomes drain (condensate). That is, in the steam-using devices 4, the target is heated by latent heat of condensation of steam (heated by latent heat). Drain (condensate) and drain (condensate) mixed with steam generated by condensation of steam in the steam-using devices 4 flow into the steam traps 5. The steam traps 5 automatically emit only influent drain from outlets thereof.

The drain recovery section 10 includes a recovery tank 21, a water supply pump 22, a flow rate control valve 23, a make-up water tank 24, and a make-up water pump 25, collects drain generated in the steam-using devices 4, and supplies (returns) the drain to the boiler 2. The drain recovery section 10 according to this embodiment is of a so-called closed type.

The recovery tank 21 stores drain generated in the steam-using devices 4, and water stored in the recovery tank 21 is supplied to the boiler 2. Specifically, the recovery tank 21 is a cylindrical container that is vertically elongated, and has an upper portion connected to outlets of the steam traps 5 through a drain inflow pipe 11 and a lower portion connected to a drum of the boiler 2 through a water supply pipe 12. Drain discharged from the steam traps 5 flows into the recovery tank 21 through the drain inflow pipe 11. Part of the influent drain is re-evaporated to be steam, which is accumulated in an upper portion of the recovery tank 21. The other part of the influent drain is accumulated in a lower portion of the recovery tank 21.

The water supply pump 22 is disposed on the water supply pipe 12, and supplies water (drain) stored in the recovery tank 21 to the boiler 2 through the water supply pipe 12. The water supply pump 22 is disposed below the recovery tank 21, and obtains a necessary lift (entrance head necessary for the pump) by the level difference between the water supply pump 22 and the recovery tank 21. The flow rate control valve 23 is disposed downstream of the water supply pump 22 on the water supply pipe 12. The flow rate control valve 23 is configured to have a changeable opening degree and adjusts the flow rate of water in the water supply pipe 12, that is, the amount of water supply from the recovery tank 21 to the boiler 2.

The make-up water tank 24 is a cylindrical container that is vertically elongated, and has an upper portion connected to an upper portion of the recovery tank 21 through an emission pipe 13 and a lower portion connected to the water supply pipe 12 through a make-up water pipe 14. Steam (re-evaporated steam) generated by re-evaporation of drain in the recovery tank 21 flows into the make-up water tank 24 through an emission pipe 13, and part of the inflow steam is condensed and accumulated in a lower portion of the make-up water tank 24. The make-up water pump 25 is disposed on the make-up water pipe 14, and supplies water stored in the make-up water tank 24 to the boiler 2 through the make-up water pipe 14 and the water supply pipe 12. A downstream end of the make-up water pipe 14 is connected to a portion of the water supply pipe 12 downstream of the flow rate control valve 23.

The steam system 1 according to this embodiment includes sensors. Specifically, the recovery tank 21 is provided with a water-level sensor 31 that detects a level of water stored in the recovery tank 21. The water supply pipe 12 is provided with a flow-rate sensor 32 that detects a flow rate of water in the water supply pipe 12 and is disposed between the flow rate control valve 23 and the make-up water pipe 14. The make-up water pipe 14 is provided with a flow-rate sensor 33 that detects a flow rate of water in the make-up water pipe 14 and is disposed downstream of the make-up water pump 25. The boiler 2 is provided with a water-level sensor 34 that detects a level of water stored in the drum and a pressure sensor 35 that detects a pressure of the drum. The supply pipe 6 is provided with a flow-rate sensor 36 that detects a flow rate of steam in the supply pipe 6.

The drain recovery section 10 includes a control unit 40 that controls driving of the flow rate control valve 23 and the make-up water pump 25 to adjust the amount of water supply to the boiler 2.

The control unit 40 is configured to receive values detected by the sensors 31, 32, 33, 34, 35, and 36. The control unit 40 is configured to adjust the amount of water supply to the boiler 2 so that the level of water stored in the recovery tank 21 is kept at a predetermined tank reference water level (target water level). In addition, when the load of the boiler 2 increases to a predetermined load, the control unit 40 reduces the tank reference water level (target water level) by a predetermined amount.

Figure 2:
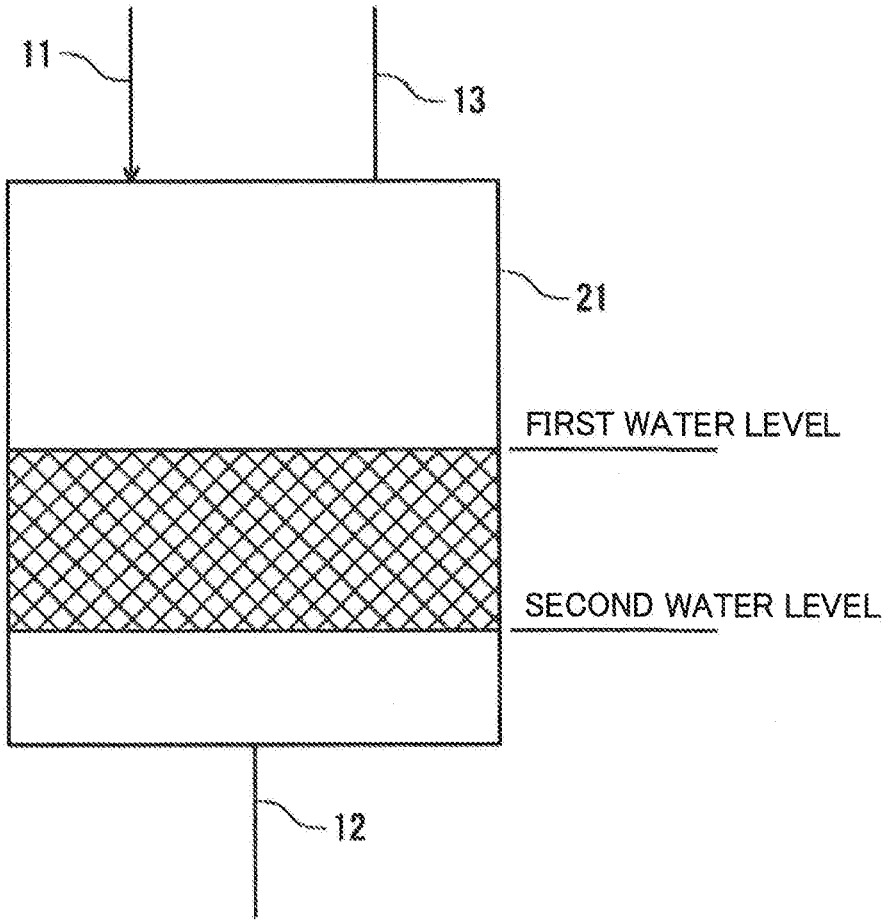
FIG. 2 is an illustration for describing a set water level of a recovery tank.

In this embodiment, as illustrated in FIG. 2, a first water level and a second water level lower than the first water level by a predetermined amount are set as tank reference water levels of the recovery tank 21. The first water level is a tank reference water level that is set when the boiler 2 is under a normal load, and the second water level is a tank reference water level that is set when the boiler 2 is under a high load (i.e., the load of the boiler 2 increases to a predetermined load).

Specifically, when the boiler 2 is under a normal load, the control unit 40 drives the water supply pump 22 while stopping the make-up water pump 25. The control unit 40 determines that the boiler 2 is under a normal load when a pressure detected by the pressure sensor 35 is a predetermined boiler reference pressure or more. The control unit 40 controls the amount of water supply from the recovery tank 21 to the boiler 2 by adjusting the opening degree of the flow rate control valve 23 so that a water level detected by the water-level sensor 31 is maintained at the first water level (tank reference water level). When the boiler 2 is under a normal load, it is possible to obtain a water supply amount necessary for the boiler 2 only with water supply from the recovery tank 21 while maintaining the level of water stored in the recovery tank 21 at the relatively high first water level.

Thereafter, when the load of the boiler 2 increases to a predetermined load (i.e., the boiler 2 reaches a high load state) in, for example, starting an operation of the steam system 1, the amount of generated steam (the amount of emitted steam) is large relative to the amount of water supply, that is, the amount of water supply runs short, in the boiler 2. Here, suppose the make-up water pump 25 is driven to supplementarily supply water stored in the make-up water tank 24 to the boiler 2, steam generated in the drum is condensed (becomes drain) so that the pressure of the drum decreases, resulting in difficulty in controlling the pressure of the drum. Specifically, since the recovery tank 21 stores high-temperature water whereas the make-up water tank 24 stores low-temperature water, when water stored in the tanks 21 and 24 is supplied to the boiler 2, the temperature of water supplied to the boiler 2 decreases, as compared to a case where only high-temperature water stored in the recovery tank 21 is supplied to the boiler 2. Thus, although the shortage of water supply is relieved in the boiler 2, the pressure of the drum decreases, resulting in difficulty in generating steam under a predetermined pressure at a predetermined temperature.

In view of this, the control unit 40 according to this embodiment changes (reduces) the tank reference water level of the recovery tank 21 from the first water level to the second water level when the load of the boiler 2 becomes a high load. When the pressure detected by the pressure sensor 35 decreases below a predetermined boiler reference pressure, the control unit 40 determines that the load of the boiler 2 becomes a high load. Under the high load, the amount of generated steam (the amount of emitted steam) is large relative to the amount of water supply in the boiler 2 as described above, the pressure of the drum decreases. The control unit 40 controls the amount of water supply from the recovery tank 21 to the boiler 2 by adjusting the opening degree of the flow rate control valve 23 so that a water level detected by the water-level sensor 31 is maintained at the second water level (tank reference water level).

In this manner, when the tank reference water level of the recovery tank 21 decreases from the first water level to the second water level, the amount of stored water corresponding to a reduced amount of the tank reference water level in the recovery tank 21 (indicated by a hatched portion in FIG. 2) can be supplied to the boiler 2. That is, in the technique disclosed in the present application, high-temperature water in a region that is stored in the recovery tank 21 under a normal load is supplied to the boiler 2. In this manner, shortage of water supply in the boiler 2 can be relieved by high-temperature stored water. Thus, low-temperature water stored in the make-up water tank 24 does not need to be supplied to the boiler 2.

In a case where the amount of water supply runs short in the boiler 2 even by reducing the tank reference water level from the first water level to the second water level, the control unit 40 drives the make-up water pump 25. Then, water stored in the make-up water tank 24 is supplementarily supplied to the boiler 2. In this case, the amount of low-temperature stored water supplementarily supplied from the make-up water tank 24 to the boiler 2 can be reduced, as compared to a conventional technique.

As described above, in this embodiment, when the boiler 2 is under a high load, the tank reference water level (target water level) of the recovery tank 21 is reduced by a predetermined amount so that the amount of water supply from the recovery tank 21 to the boiler 2 can be increased by an amount corresponding to the predetermined amount of the tank reference water level. In this manner, low-temperature water stored in the make-up water tank 24 does not need to be supplied to the boiler 2 or the amount of water supplementarily supplied to the boiler 2 can be reduced. Accordingly, it is possible to suppress a decrease in pressure of the drum while the boiler 2 is under a high load, and thus, steam under a predetermined pressure and a predetermined temperature can be generated in the boiler 2. As a result, the pressure of steam supplied to the steam-using devices 4 can be stabilized. In addition, since the pressure decrease in the drum can be suppressed, water stored in the drum does not need to be unnecessarily heated, resulting in energy saving.

In the control unit 40 according to the embodiment described above, the state of load of the boiler 2 is determined based on the pressure of the drum. The present application, however, is not limited to this example, and the state of load of the boiler 2 may be determined in the following manner The control unit 40 determines that the boiler 2 is under a normal load when the water level of the boiler 2 detected by the water-level sensor 34 is a predetermined boiler reference water level or more. When the boiler 2 is under a high load, the amount of generated steam (the amount of emitted steam) is large relative to the amount of water supply in the boiler 2 as described above, the amount of water stored in the drum decreases. When the water level detected by the water-level sensor 34 decreases below the predetermined boiler reference water level, the control unit 40 determines that the boiler 2 becomes under a high load and changes (reduces) the tank reference water level of the recovery tank 21 from the first water level to the second water level.

As another example, the control unit 40 preliminarily may have a correlation between a mass flow rate of water supplied to the boiler 2 and a mass flow rate of steam emitted from the boiler 2 when the boiler 2 is under a normal load. In this example, the control unit 40 is configured to calculate the mass flow rate of water based on the flow rates detected by the flow-rate sensors 32 and 33 and calculate the mass flow rate of steam based on the flow rate of the flow-rate sensor 36. When the mass flow rate of steam emitted from the boiler 2 exceeds a value in the correlation, the control unit 40 changes (reduces) the tank reference water level of the recovery tank 21 from the first water level to the second water level. This is because the amount of generated steam (the amount of emitted steam) is large relative to the amount of water supply in the boiler 2 as described above when the boiler 2 under a high load.

In the above embodiment, the two water levels (i.e., the first water level and the second water level) are set as tank reference water levels of the recovery tank 21. Alternatively, three or more water levels may be set. That is, in the above embodiment, the state of load of the boiler 2 may be classified into three or more groups so that a water level is set in accordance with each state of load. Specifically, in a case where the state of load of the boiler 2 is classified into three loads: a low load, an intermediate load, and a high load, for example, a first water level, a second water level (lower than the first water level), and a third water level (lower than the second water level) are set as tank reference water levels in correspondence with the low load, the intermediate load, and the high load, respectively.

The steam-using devices 4 according to the above embodiment may be devices that sterilize a bottle or other objects by heat using steam or devices that keep the temperature of oil by heat using steam by winding a steam pipe around an oil transfer pipe, as well as heat exchangers.

The technique disclosed in the present application may use a configuration constituted by a part or a combination of two or more of the configurations described in the above embodiment.

INDUSTRIAL APPLICABILITY

The technique disclosed in the present application is useful for a drain recovery device that collects drain generated in a steam-using device and supplies the drain to a boiler.

What is claimed is:

1. A drain recovery device comprising:

a recovery tank in which drain generated by condensation of steam in a steam-using device is stored and from which water stored in the recovery tank is supplied to a boiler; and a control unit that controls an amount of water supply from the recovery tank to the boiler to maintain a water level of water stored in the recovery tank at a predetermined tank reference water level, wherein a first water level and a second water level lower than the first level are set as the tank reference water level, the boiler includes a container in which water supplied from the recovery tank is stored and is heated to be steam, the drain recovery device includes a pressure sensor that is disposed in the boiler and detects a pressure of the container of the boiler, and when the pressure detected by the pressure sensor decreases below a predetermined boiler reference pressure, the control unit changes the tank reference water level from the first water level to the second water level.

2. A drain recovery device comprising:

a recovery tank in which drain generated by condensation of steam in a steam-using device is stored and from which water stored in the recovery tank is supplied to a boiler; and a control unit that controls an amount of water supply from the recovery tank to the boiler to maintain a water level of water stored in the recovery tank at a predetermined tank reference water level, wherein a first water level and a second water level lower than the first level are set as the tank reference water level, the boiler includes a container in which water supplied from the recovery tank is stored and is heated to be steam, the drain recovery device includes a water level sensor that detects a water level of water stored in the container of the boiler, when the water level detected by the water level sensor decreases below a predetermined boiler reference water level, the control unit changes the tank reference water level from the first water level to the second water level.

3. A drain recovery device comprising:

a recovery tank in which drain generated by condensation of steam in a steam-using device is stored and from which water stored in the recovery tank is supplied to a boiler; and a control unit that controls an amount of water supply from the recovery tank to the boiler to maintain a water level of water stored in the recovery tank at a predetermined tank reference water level, wherein the control unit preliminarily has a correlation between a mass flow rate of water supplied to the boiler and a mass flow rate of steam emitted from the boiler when the boiler is under a normal load, and when the mass flow rate of steam emitted from the boiler exceeds a value in the correlation, the control unit reduces the tank reference water level by a predetermined amount.

* * * * *